US005109599A

United States Patent [19]

Ohlhaber

[11] Patent Number: 5,109,599

[45] Date of Patent: May 5, 1992

[54] MINIATURE COAXIAL CABLE BY DRAWING

[75] Inventor: Ronald L. Ohlhaber, Geneva, Ill.

[73] Assignee: Cooper Industries, Inc., Houston, Tex.

[21] Appl. No.: 686,711

[22] Filed: Apr. 15, 1991

Related U.S. Application Data

[63] Continuation of Ser. No. 555,882, Jul. 20, 1990, abandoned.

[51] Int. Cl.[5] ..... H01B 13/20

[52] U.S. Cl. ..... 29/828; 156/51; 156/52; 156/56

[58] Field of Search ..... 29/828; 156/51, 52, 156/56; 174/1105 R, 102 C; 427/117, 118

[56] References Cited

U.S. PATENT DOCUMENTS

| | | | |
|---|---|---|---|
| Re. 28,961 | 9/1976 | Tusukamoto et al. . | |
| 2,645,590 | 7/1953 | Mildner et al. . | |
| 2,823,152 | 2/1958 | Mildner et al. . | |
| 3,553,811 | 1/1971 | Garner . | |
| 3,567,846 | 3/1971 | Brorein et al. | 29/828 X |
| 3,569,610 | 3/1971 | Garner et al. | 29/828 X |
| 3,685,147 | 8/1972 | Nevin et al. . | |
| 3,693,250 | 9/1972 | Brorein et al. . | |
| 3,710,440 | 1/1973 | Nevin et al. . | |
| 4,017,344 | 4/1977 | Lorber | 156/52 |
| 4,083,484 | 4/1978 | Polizzano . | |
| 4,139,936 | 2/1979 | Abrams et al. . | |
| 4,229,238 | 10/1980 | Saito | 156/56 x |
| 4,270,961 | 6/1981 | Faranetta et al. | 156/51 |
| 4,304,713 | 12/1981 | Perelman | 29/828 X |
| 4,482,412 | 11/1984 | Schleese et al. | 156/51 |
| 4,487,999 | 12/1984 | Baird et al. . | |
| 4,560,829 | 12/1985 | Reed et al. | 29/828 X |
| 4,647,716 | 3/1987 | Akiyama et al. . | |
| 4,715,098 | 12/1987 | Booth et al. . | |
| 4,816,618 | 3/1989 | Bongianni | 156/51 X |

FOREIGN PATENT DOCUMENTS

| | | |
|---|---|---|
| 1160683 | 9/1970 | Fed. Rep. of Germany . |
| 284081 | 7/1971 | U.S.S.R. . |

*Primary Examiner*—Carl J. Arbes
*Attorney, Agent, or Firm*—Eddie E. Scott; William B. Patterson; Alan R. Thiele

[57] ABSTRACT

The method of making a miniature co-axial cable of the present invention includes the insertion of a pre-sized, conductive core into an outer cover with supporting material to center the core. The assembly is then heated and the thermoplastic cover and core supporting material is drawn down around the central core. The result is a miniature co-axial cable with a precise amount of air space, or dielectric region between the core and the outer cover.

15 Claims, 1 Drawing Sheet

MINIATURE COAXIAL CABLE BY DRAWING

This application is a continuation of application Ser. No. 07/555,882, filed Jul. 20, 1990, now abandoned.

BACKGROUND OF INVENTION

This invention relates to the manufacture of miniature coaxial cable by heating and drawing a thermoplastic, outer material around a pre-sized, central core.

The production of miniature coaxial cable depends on the ability to fabricate a cross-sectional cable with extremely small and accurate dimensions. One method of making miniature coaxial cable is a plastic extrusion process.However, the extrusion process is slow and precise sizing is difficult. Another method involves the wrapping of a conductive tape around the core. Again, this method is slow and precise tolerances difficult to attain.

One object of this invention is a method of manufacturing miniature coaxial cable resulting in a precise amount of air spaced between the core and the outer covering to ensure maximum propagation of electronic signal.

Another object of this invention is a method of manufacturing miniature coaxial cable using a heating and drawing process.

Yet another object of the invention is a method of manufacturing a miniature coaxial cable at a high speed.

SUMMARY OF INVENTION

This invention has, as its primary objective, the provision of a fast method of manufacturing miniature coaxial cable with a precise amount of air space between core and cover through a heating and drawing process. A pre-sized central core is fed into a thermoplastic outer cover and held in place by thermoplastic supporting material. The assembly is then heated in a furnace and the outer cover and support material is drawn down around the central core. The drawing process determines the exact amount of reduction of the outer cover and support material. Typical reduction of 10 to 50 times is possible and the process can be repeated to further reduce the diameter of the outer cover and support plates. The result is a miniature coaxial cable with a precise amount of air space between the core and the outer cover. In addition, the reduced supporting material acts to increase the propagation velocity of the electronic signal.

DESCRIPTION OF AN EMBODIMENT

Figure 1:
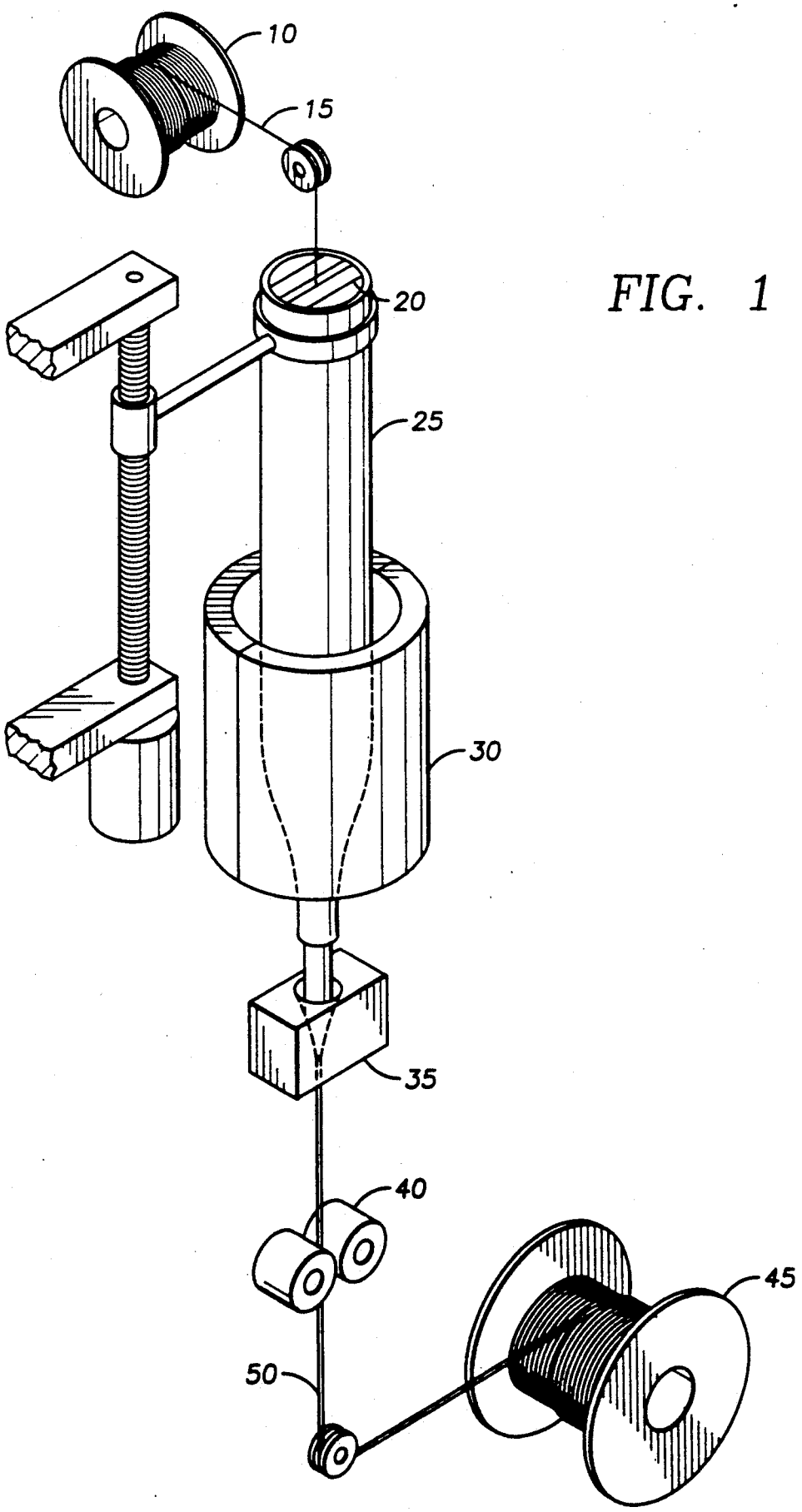
FIG. 1 is a perspective view of the apparatus used in the method that is the subject of the invention.

As depicted in FIG. 1, the central core of the coaxial cable (15) is pre-sized and can be feed from a reel (10). The central core can be copper wire or some other conductive material. The outer cover (25) is a tube-shaped, thermoplastic, usually plastic or glass. Between the core and cover is a supporting material (20) that is reduced in size along with the cover during the drawing process. The supporting material, after it has been reduced, serves to center the core in the outer cover and provide air space between the core and outer cover for a precise dielectric region. The supporting material can consist of plastic plates which run the length of the cover and expand radially inward from the wall of the cover. The plates are made of material similar to the cover so that they can be heated and drawn simultaneously. Many cross sectional combinations of support elements are possible to increase the air space between the core and the cover to improve the propagation velocity of the electronic signal and it will be understood that the shape and size of the supporting material is not limited to the described embodiment. For example, the supporting material can also be constructed of foam. The foam, like the plastic plates is reduced around the core during drawing. Because the foam is air-filled, it supplies the necessary air space which is the dielectric region, between the core and the cover.

In the claimed process, the pre-sized core (15) is fed from a reel or other source into the center of a tube-shaped cover containing plastic supports which center the core in the cover. The structure is then lowered into a cylindrical furnace (30) which heats it to the appropriate temperature for drawing of the cover and support plates, both of which have similar thermal properties. The pre-sized core, because of its different thermal properties will remain unchanged as the cover and support members are drawn around it. The drawing operation is done while the structure move through the furnace and the cover and support members are reduced to provide an exact amount of air space between cover and core. The structure is then air-cooled as it leaves the furnace and coated with a liquid conductive layer (35) the conductive material can also consist of a foil wrap, a metallic film deposit or a metallic braided wire. The completed cable (50) is then rolled onto a reel (45) or other collecting device. The method described above solves the problem of manufacturing precise miniature coaxial cable at a high speed.

I claim:

1. A method of making miniature coaxial cable by drawing, which comprises the steps of:
   - feeding a pre-sized core into a tube-shaped outer cover containing supporting material;
   - heating said core, outer cover and supporting material to a given temperature to allow drawing of the outer cover and supporting material;
   - drawing said outer cover and said supporting material around said core until there is the desired amount of conductive air space between said central core and said outer cover; and
   - applying a conductive material to said outer cover.

2. A method as described in claim 1 wherein said supporting material and outer cover have similar thermal properties which are different than said core.

3. A method as described in claim 1 further comprising the step of lowering said core, cover and supporting material into a furnace prior to heating.

4. A method as described in claim 1 further comprising the step of cooling said core, covering and supporting material to a desired temperature after it is drawn.

5. A method as described in claim 4 wherein said cooling is done with gas.

6. A method as described in claim 1 wherein said conductive material consists of a liquid coating.

7. A method as described in claim 1 wherein said conductive material consists of a foil wrap.

8. A method as described in claim 1 wherein said conductive material consists of a metallic film deposit.

9. A method as described in claim 1 wherein said conductive material consists of a metallic braided wire.

10. A method as described in claim 1 further comprising the step of collecting the finished cable after cooling.

11. A method as described in claim 10 wherein said collecting is accomplished with the use of a reel.

12. A method as described in claim 1 wherein said supporting material consists of thermoplastic strips which run the length of the outer cover.

13. A method as described in claim 1 wherein said supporting material consists of air-filled foam.

14. A method as described in claim 1 wherein said outer cover is made of glass.

15. A method as described in claim 1 wherein said outer cover is made of plastic.

* * * * *